United States Patent [19]

VanPatten

[11] 4,370,636

[45] Jan. 25, 1983

[54] ELECTROMAGNETIC DUAL BREAK CONTACTOR

[75] Inventor: John R. VanPatten, Waynesboro, Va.

[73] Assignee: General Electric Company, Salem, Va.

[21] Appl. No.: 250,825

[22] Filed: Apr. 3, 1981

[51] Int. Cl.[3] ..... H01H 67/02

[52] U.S. Cl. ..... 335/132; 335/195; 200/147 R

[58] Field of Search ..... 335/16, 132, 201, 195; 200/147

[56] References Cited

U.S. PATENT DOCUMENTS

| | | | |
|---|---|---|---|
| 1,933,175 | 10/1933 | Jansson | 200/147 |
| 2,059,702 | 11/1936 | Matthias | 200/166 |
| 2,092,478 | 9/1937 | Sommermeyer | 200/145 |
| 2,214,530 | 9/1940 | Janser | 200/166 |
| 2,450,256 | 9/1948 | Rowe | 200/151 |
| 2,575,060 | 11/1951 | Matthias | 200/147 |
| 2,629,036 | 2/1953 | Brown | 200/147 |
| 3,155,790 | 11/1964 | Lemonnier | 200/87 |
| 3,459,914 | 8/1969 | Gustavson | 200/170 |
| 3,483,343 | 12/1969 | Heft | 200/147 |
| 3,555,471 | 1/1971 | Mitskevich et al. | 335/195 |
| 3,962,658 | 6/1976 | Zunft et al. | 335/132 |
| 4,258,345 | 3/1981 | Malick | 335/201 |

*Primary Examiner*—George Harris

*Attorney, Agent, or Firm*—James H. Beusse; Ormand R. Austin

[57] ABSTRACT

An electromagnetically operated, straight-line motion dual-break electrical contactor has current conductors entering a contact area from opposite directions. In the contact area the conductors are closely spaced and have finite parallel substantially flat portions with an insulative divider to prevent conductor to conductor arcing. A pivotable contact carrying bridge spans the conductors. The pivotable bridge compensates for contact wear or displacement. Screens are arranged in arc blow paths to aid in extinguishing arcs. The contactor arrangement and spacing controls the direction and enhances the magnitude of arc blow.

13 Claims, 12 Drawing Figures

ELECTROMAGNETIC DUAL BREAK CONTACTOR

BACKGROUND OF THE INVENTION

The present invention relates to electric circuit breakers and, more particularly, to an electromagnetically operated straight line motion dual-break contactor of the enclosed arc chamber type.

Electromagnetically operated dual-break contactors are generally constructed such that an armature is operated by an electrically generated magnetic field to cause displacement of moveable contacts to either engage with or disengage from fixed contacts. Springs are commonly employed to return the armature and moveable contacts to their non-energized position.

Opening the contacts in such contactors usually results in an arc being formed between the moveable and fixed contacts, particularly in circuits where a relatively large direct current (DC) is being interrupted. The temperature of such electric arcs, varying between 6,000 and 20,000 degrees Kelvin, exceeds the melting temperature of known metals and will cause melting and vaporization of the surfaces of the contacts. Melting and vaporization of the contact surfaces produce pitting and other surface irregularities which may reduce the area of surface contact on closure and increase the likelihood of contact welding due to the smaller current carrying area.

Numerous features have been incorporated in contactors in efforts to minimize contact arcing with the intent being to extinguish the arc as rapidly as possible. Since an arc can be extinguished by either reducing the voltage which sustains it or by extending or dividing the arc so that the existing voltage is insufficient to sustain it, approaches to arc extinction have included arc chutes to divide and/or extend the arc and air and magnetic devices to "blow" the arc out by extension. While these approaches are useful in relatively large contactors, their application to smaller contactors has not always been practical. For example, a 100 ampere contactor for an electric truck or car must be relatively small unit in which it is impractical to use air or magnetic devices of sufficient strength to blow out a fault current arc or to use a bulky arc chute to extinguish such an arc. In addition, the small size of such contactors limits the maximum available contact separation to a magnitude insufficient for fault current arc extinction. Although magnetic blow-out coils are often used in smaller sized contactors, commercially available contactors do not meet the size requirements for an electric vehicle and yet have suitable fault current arc extinction capability to yield long contact life.

It is an object of the present invention to provide an improved electromagnetically operated dual-break electrical contactor.

It is another object of the present invention to provide an electromagnetically operated dual-break electrical contactor of relatively small size but with relatively large current interrupting capability.

It is a still further object of the present invention to provide an electromagnetically operated dual-break electrical contactor of relatively small size that will interrupt a fault current of several times its rated current capacity.

It is still another object of the present invention to provide an electromagnetically operated dual-break electrical contactor in which arcs occurring between the contacts are effectively directed away from the contact tips and into an arc cooling screen without using permanent magnets, magnetic coils, air blasts or arc chutes.

SUMMARY OF THE INVENTION

The present invention comprises a small, compact electromagnetically operated dual-break electrical contactor having high current interrupting capability without the use of arc chutes or external stimuli. The contactor is of the straight line motion type in which an armature, actuated by an electromagnetic coil, carries a moveable pivoting contact bridge on which a pair of contact tips are mounted. Energization of the coil creates a magnetic field which attracts the armature and causes the contact tips to mate with corresponding fixed contacts on a pair of conductors thereby creating a current path between the conductors through the contact bridge. De-energization of the coil allows the armature to relax and open the contact tip pairs whereupon arcing generally occurs.

The conductors are mounted on an insulative base member. One conductor extends from an edge of the base member to a termination point on the surface. The other conductor extends from an edge of the base member in a direction toward the extending direction of the one conductor. The conductors have close, parallel overlapping portions in the contact area with the contact tips being mounted near the terminating end of each conductor. The close juxtapositioning of the fixed contact tips causes the magnetic fields generated by arcs between the fixed and moveable contact tips to be effective in pushing the arcs apart and away from the tips. This effect is minimal at low currents but becomes extremely violent at high currents. In addition, the conductors are chosen to be relatively thin with respect to their widths so that the magnetic fields created by conductor current also act to deflect the arcs.

In one embodiment the contactor of the present invention also includes arc screens, preferably arranged in pairs, positioned in the path of any deflected arcs so as to aid in cooling and extinguishing the arcs. The screens function to split each arc into two arcs when they impinge on the screens. This doubles the values of the anode and cathode voltage drops of the arcs and aids extinguishment. To prevent arcs from igniting between conductors, an arc barrier in the form of a moveable insulative sheet is positioned between the conductors and arranged to move in conjunction with the contact bridge. With this arrangement the contactor has been made capable of repetitively interrupting fault currents of a magnitude 10 times that of rated current, i.e., a 100 ampere contactor will repetitively interrupt 1000 amperes with minimal degradation of the contact tips.

BRIEF DESCRIPTION OF THE DRAWINGS

The above and other objects, features and advantages of the present invention will become apparent from a reading of the following detailed description taken in conjunction with the appended drawings, in which:

FIG. 6, comprising

DETAILED DESCRIPTION

Figure 1:
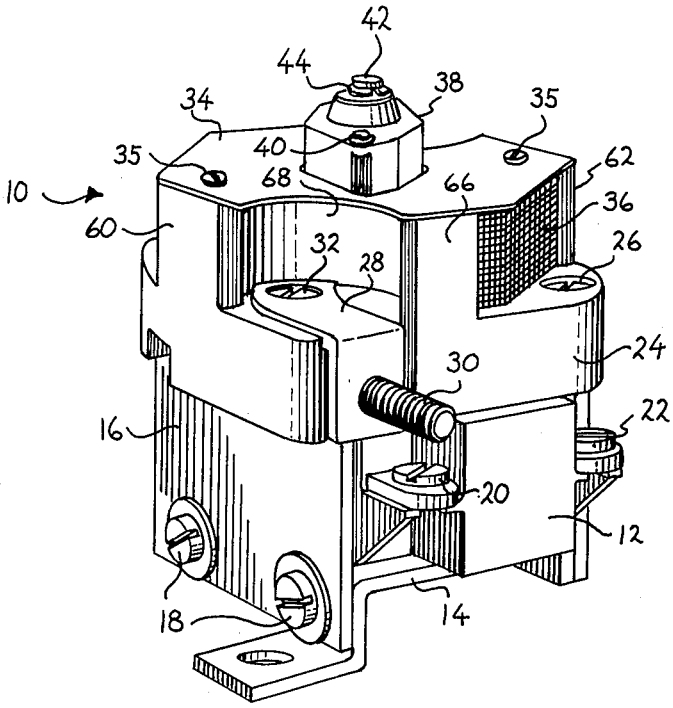
FIG. 1 is a perspective view of an electromagnetically operated straight line motion, dual-break electrical contactor constructed in accordance with the present invention.

Referring now to FIG. 1 there is shown an external perspective view of a dual break contactor 10 according to the present invention. The contactor 10 includes an enclosed coil assembly 12 mounted in a housing comprising a bottom flanged member 14 and a U-shaped frame member 16. The frame member 16 is joined to the flange member 14 by means of four screws 18, two of which are visible in the view shown in FIG. 1. Union of the frame member 16 to the flange member 14 by means of screws 18 permits ease of assembly and disassembly for installation and removal of the coil assembly 12. The coil assembly 12 includes first and second terminals 20 and 22 for connection to a source of electrical power.

The electrical contacts for the contactor 10 are located inside a housing mounted atop the frame member 16. The housing comprises a substantially flat base member 24 which attaches to the member 16 by screws, one of which is visible at 26. A conductor 28 attached to the base member 24 conducts power from a screw terminal 30 to the contacts within the base member 24. The conductor 28 is fitted within a groove formed in the insulative base member 24 and held in place by means of a screw 32. A cover 34 limits access to the contact area and also prevents debris from falling into that area. The cover 34 is held in place by means of screws 35. Also visible in FIG. 1 is one of several metal mesh screens 36 which are used to cool and aid in extinguishing arcs generated between contacts. Both the base member 24 and cover 34 are preferably molded from a glass-filled polyester plastic.

The movable contact members are carried within a movable insulative housing 38 which is moved up and down by metallic rod members, one of which is visible at 40, that are connected to an armature (not shown) of the coil assembly 12. A more detailed view of an armature, coil assembly and return spring is shown, by way of example, in U.S. Pat. No. 2,575,060. A shaft 42, held in place by a lock ring, 44, passes through the center of housing 38 and attaches to a contact bridge (not the visible) inside the housing 38, the moveable contacts being mounted on the contact bridge.

Figure 2:
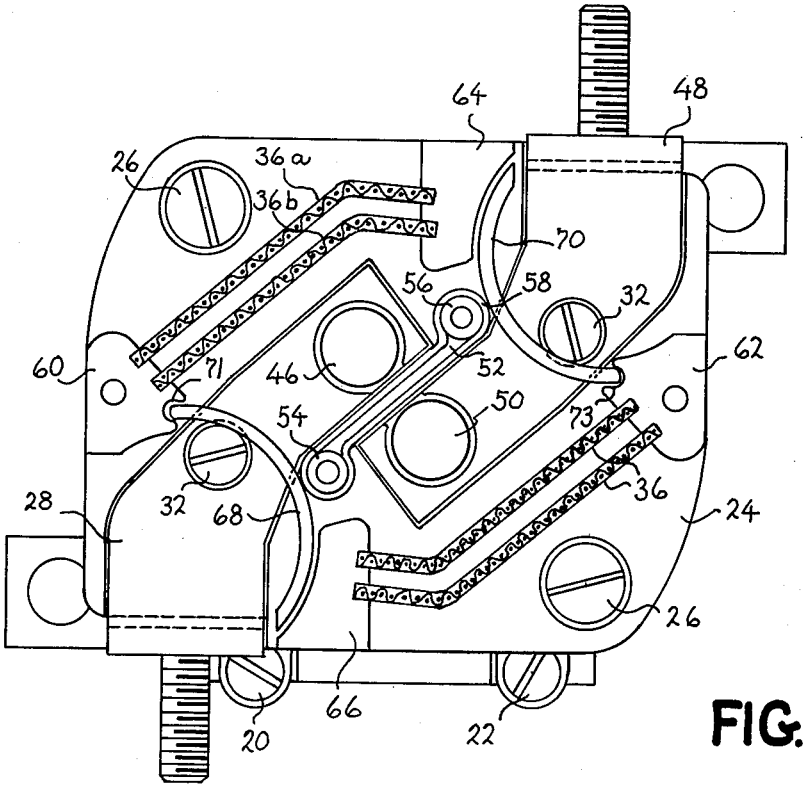
FIG. 2 is a top view of the contactor of FIG. 1 with its cover removed and the moveable contact bridge and its housing omitted.

Referring now to FIG. 2, there is shown a view looking down on the contactor 10 of FIG. 1 with the cover 34 removed. The movable contact bridge and associated housing 38 are also omitted from the view of FIG. 2. The conductor 28 is seen to extend from an edge of the base member 24 to a termination point near the center of the base member. A contact tip 46 is attached near the termination point of the conductor 28. A second conductor 48, identical to the conductor 28, begins at an opposite edge of the base number 24 and extends toward the conductor 28. The conductor 48 terminates at a point such that a finite portion of conductor 48 extends parallel to and overlaps a finite portion of conductor 28. As will be apparent from FIG. 2, "overlap" in the sense used in this description means that the conductors 28 and 48 have side by side portions in the plane of the upper surface of the base member 24, the upper surface being the distal surface with respect to the surface contacting the frame member 16. A contact tip 50 is attached near the end of the conductor 48 adjacent the contact tip 46. Both conductor 28 and conductor 48 have a small surface area extending beyond their respective contact tips to provide a surface for arcs to move away from the contact tips.

The conductors 28 and 48 are electrically insulated from each other at their overlapping portions by means of an insulative member 52 interposed between their finite overlapping portions. The member 52 moves in conjunction with the movable contact bridge and in this respect has hollow leg portions 54 and 56 on each end thereof through which the rods 40 pass. The member 52 moves in an opening 58 formed in the base member 24.

As can be seen from the combination of FIG. 1 and FIG. 2, the base member 24, although having a substantially flat upper surface, has four upwardly extending portions 60, 62, 64 and 66 upon which the cover 34 rests. The portions 60 and 62 each contain a threaded aperture for receiving the screws 35 which hold the cover 34 in position. The cover 34 is preferably a molded unit and includes depending arcuate sections 68 and 70 which serve to isolate the area in the immediate vicinity of the contacts 46 and 50 (the "contact area") while providing access to the conductors 28 and 48 when the cover 34 is removed. For better stability and isolation, one end of the arcuate section 68 fits into a groove 71 formed in the upright portion 60 and one end of the arcuate section 70 fits into a groove 73 formed in the upright portion 62.

Screens 36, which aid in cooling and extinguishing arcs generated in the contact area, are held in place by being positioned in grooves formed in the upright portions 60, 62, 64, and 66 of base member 24. The screens 36 are duplicated on each side of the contact area. In a preferred embodiment, the screens 36 each comprise first and second spaced screens 36*a* and 36*b*. The use of a pair of metal mesh screens of T-305 stainless steel or similar heat resisting metal in a 14 by 14 mesh size having 0.020 inch wire diameter has been more effective and less subject to early destruction than a single screen of smaller mesh size. Smaller mesh screen also tends to create a back pressure on the arc pushing the arc back into the contact area. The use of larger mesh screens 36 significantly improves the arc extinguishing capability of the present inventive contactor as compared to prior art enclosed arc chamber contactors in which a solid wall forces the arc back towards the contact tip area. In addition, the use of screens 36 eliminates the need for bulky and costly arc chutes commonly used in such contactors.

Figure 3:
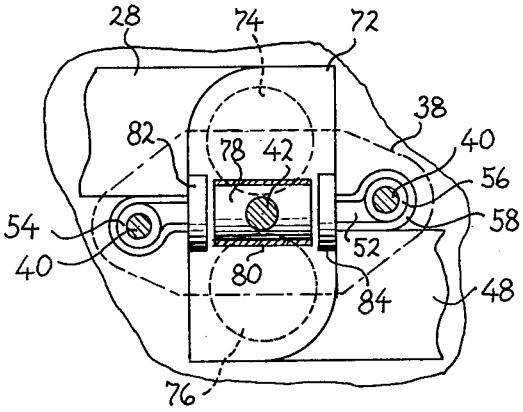
FIG. 3 is a partial top view of the contactor of FIG. 1 illustrating the placement of the moveable contact bridge.

Referring now to FIG. 3, there is shown a partial view looking down on the contact area but with the movable contact bridge, designated at 72, being shown in position over the contacts 46 and 50. It can be seen that the movable bridge 72 is attached at its center point to the shaft 42 by means of a frictional bearing. The housing 38 is shown in dashed lines. The rods 40 are shown passing through the leg portions 54 and 56 of the insulative member 52. The contact carrying bridge 72, having contact tips 74 and 76 on its underside, is attached to the shaft 42 by means of a cylinder and sleeve arrangement forming the frictional bearing. A cylinder 78 fits snugly inside a sleeve 80, the sleeve 80 being firmly attached to the bridge 72. The cylinder 78 is prevented from sliding out of the sleeve 80 by means of a pair of disc-shaped members 82 and 84 attached to the bridge 72 at opposite ends of the cylinder 78. The members 82 and 84 may be attached to bridge 72 by brazing or welding.

Figure 4:
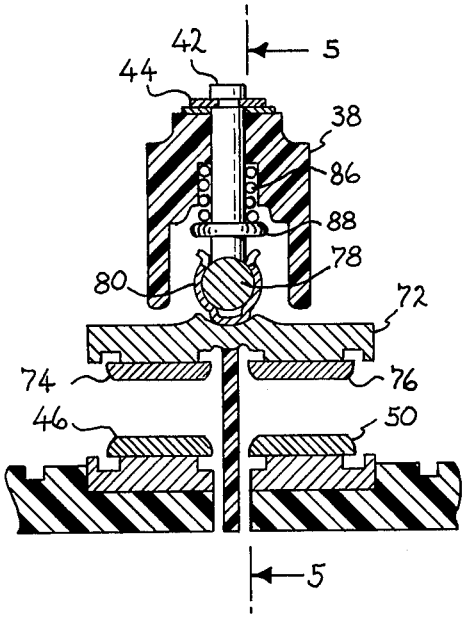
FIG. 4 is a partial cross-sectional view of the contactor of FIG. 1 illustrating the contact bridge and housing arrangement.

Referring now to FIG. 4 there is shown a partial cross-sectional view of the contact area of the contactor 10 in which the conductor contact tips 46 and 50 and the bridge contact tips 74 and 76 are each illustrated. The shaft 42 extends through the housing 38 and attaches to the cylinder 78 by brazing or other means well known in the art. A spring 86 fits around the shaft 42 and is captured between an inside surface of the housing 38 and a collar 88 firmly attached to the shaft 42. The spring 86 serves as a shock absorber and establishes the force with which the contact tips are held together when the housing 38 is pulled downward by the armature of the coil 12 to close the contacts. The sleeve 80 is preferably attached to the contact bridge 72 by brazing or spot welding. Sleeve 80 includes a slot lengthwise along its upper surface which is sufficiently wide to permit the sleeve to rotate or pivot slightly about the cylinder 78. For clarity, the disc members 82 and 84 are omitted from FIG. 4.

Figure 5:
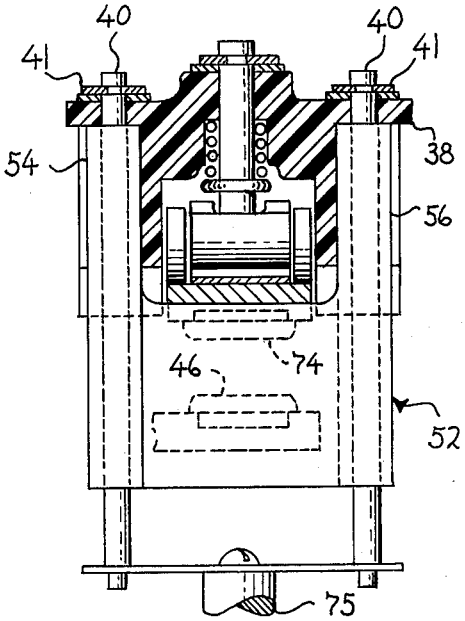
FIG. 5 is a partial cross-sectional view taken along the lines 5—5 of FIG. 4.

FIG. 5 is a cross sectional view of the contact tip area taken along the lines 5—5 in FIG. 4. In this view the construction of the insulative member 52 can be more clearly seen. The rods 40 extend through the member 52 and through an opening in base member 24 where they may be attached to an armature 75 of the coil assembly 12 in a manner well known in the art. At the upper portion of housing 38 the rods 40 are held in position by snap rings 41. The leg portions 54 and 56 of the member 52 extend into recessed areas in the housing 38. The extending leg portions 54 and 56 of member 52 are sized so as to provide a frictional fit with housing 38. This insures that the member 52 will move in conjunction with the housing 38 to maintain its insulating relationship with respect to the contacts 74 and 76 on the bridge member 72.

Figure 6C:
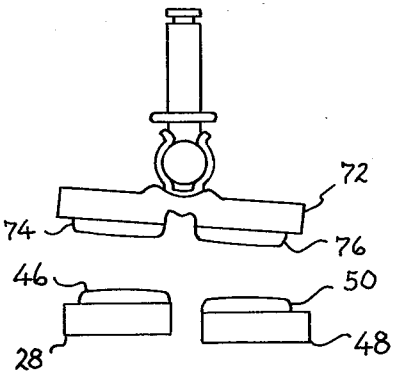
FIGS. 6A, 6B and 6C, illustrates the pivoting arrangement of the contact bridge.
Figure 6B:
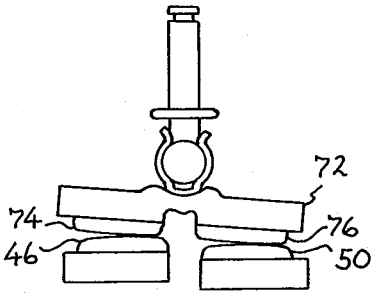
Figure 6A:
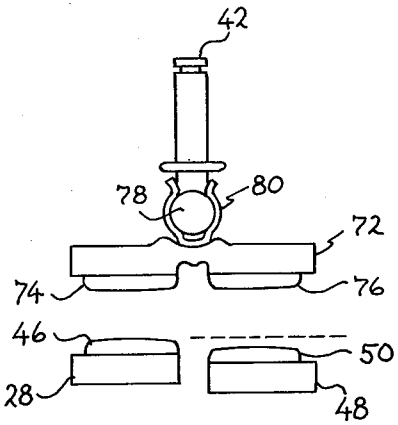

Referring now to FIG. 6, comprising the three separate drawing FIGS. 6A, 6B, and FIG. 6C, there is illustrated the pivoting action of the bridge member 72 by the cylinder and sleeve arrangement described above. For purposes of illustration, the relative displacement of contact tips 46 and 50 from a horizontal plane, has been exaggerated. In FIG. 6A the contact bridge 72 is shown raised so that the current path between conductors 28 and 48 is interrupted. The surface of contact tip 50 is located in a horizontal plane lower than the plane of the surface of contact tip 46. Consequently, when the bridge member 72 is forced downward the contact tip 74 will make contact with tip 46 prior to the closing between contact tips 50 and 76.

In FIG. 6B the contact tips are shown in a closed configuration wherein the bridge member 72 has pivoted so that both sets of contact tips are closed.

In FIG. 6C the contact bridge 72 is shown in its raised position after opening of the contacts. As is apparent, the pivoted position of the contact member 72 is maintained after opening. This achieves two results: both sets of contact tips open at the same time and, on subsequent closure, both sets of contacts close simultaneously.

The advantage of closing both sets of contacts simultaneously is that contact "bounce" on closing is minimized. Since contact bounce can create many small arcs, it is often a major contributor to contactor erosion, particularly if it is allowed to continue for very long, e.g., several milliseconds. In most contactors, the moveable bridge pivots freely about its center point and will oscillate in a see-saw fashion for several milliseconds. In this invention, the snug, spring fit of sleeve 80 about cylinder 78 has consistently yielded contact bounce times that have been measured between zero and one to two milliseconds, maximum.

The advantage of opening both sets of contacts simultaneously is to generate two equal intensity arcs one between the contact tips 50 and 76 and the other between the contact tips 46 and 74. If one pair of contact tips opens prior to the other, a more intense arc is generated between the open contact tips since the full voltage between the conductors 28 and 48 will appear across the open contact tip pair.

The sleeve and cylinder arrangement for connecting the member 72 to the shaft 42 permits the member 72 to pivot as the contact tips wear due to arc erosion. The tight fit between the sleeve and cylinder maintains the bridge 72 in its pivoted position so that arcing between contact tips on opening or closing is equalized and minimized.

Figure 7:
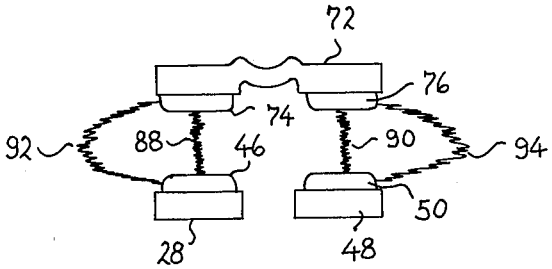
FIG. 7 is a partial cross-sectional view of the contact tip pairs illustrating the arcing which occurs on contact opening.

Although the structural aspects of the invention thus far described are believed sufficient to enable anyone skilled in the art to make and use the invention, a better understanding of the inventive features of the invention may be had by reference to FIGS. 7 through 10. FIG. 7 is a partial cross-sectional view of the contact contact tip pairs with arc formation on contact opening illustrated. Current from conductor 28, through bridge 72 and thus to conductor 48 continues after the contacts have opened by creation of one arc 88 between tips 46 and 74 and a second arc 90 between tips 76 and 50. As is well known, opening the contact tips under load conditions results in an arc so long as the initial potential between the contact tips is sufficient to create ionized material. Once initiated the heat generated by the arc volatizes the metal of the contact tips so that an arc plasma consisting of volatized and ionized metals serves as a current path. Current through the arc plasma creates a circular magnetic flux field around each of the current paths. Because the current flow through the two parallel streams of arc plasma is in opposite directions, the magnetic fields between the streams oppose each other thereby forcing the arcs to bow outward in opposite directions. The expected positions of the outward bowing arcs are indicated at 92 and 94.

Figure 8:
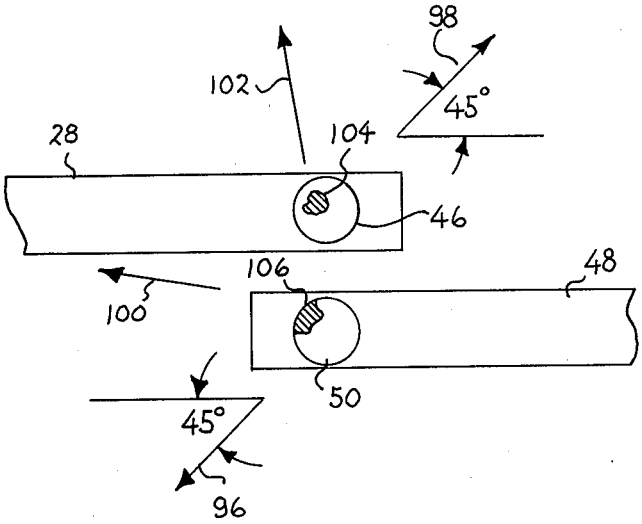
FIG. 8 is a representational view of the current conductors in the contactor of FIG. 1 illustrating the expected and actual resultant flux fields acting on generated arcs.

Referring to FIG. 8 there is shown a representational top view of the conductors 28 and 48 which illustrating the expected and actual resultant flux field forces acting on arcs between the contact tip pairs 46, 74, and 50, 76. The arrows indicated at 96 and 98 represent the directions in which it was expected that arcs would move.

These arrows represent the resultant vector forces on the arcs and were derived from the forces generated by current in the arcs per se and by current in the conductors 28 and 48. However, when the contactor was constructed using square cross-sectional conductors, the actual direction of arc movement was in the directions indicated by the arrows 100 and 102. In addition, the contact tips 46 and 50 were burned in the locations indicated at 104 and 106. In subsequent tests the arcs tended to vary their position without apparent reason.

Although review of the prior art failed to explain the phenomenon observed in the experiments, continuing modifications to the initial design led to the belief that current distribution in the square cross-section conductors was affecting the forces on the arcs. This belief was supported by conductor current distribution graphs such as that shown in FIGS. 5–17 of the text *Electric Contacts* by R. Holm, published in 1967 by Springer-Verlag, New York, N.Y. The textual reference describes direct current distribution in a disc-shaped contact as being uniformly distributed. Reasoning suggested that the same type of distribution would exist in a conductor carrying direct current, i.e., the current would be equally distributed within the conductor such that a large portion of the current entering the contact tips would be flowing in the same direction as current in the arc itself. Accordingly, by making the conductor relatively thin and wide, i.e., having a width several times its thickness, it has been found that the major portion of the current entering each contact tip will enter at right angles to the current direction in the arc and produce the desired effect.

Figure 9:
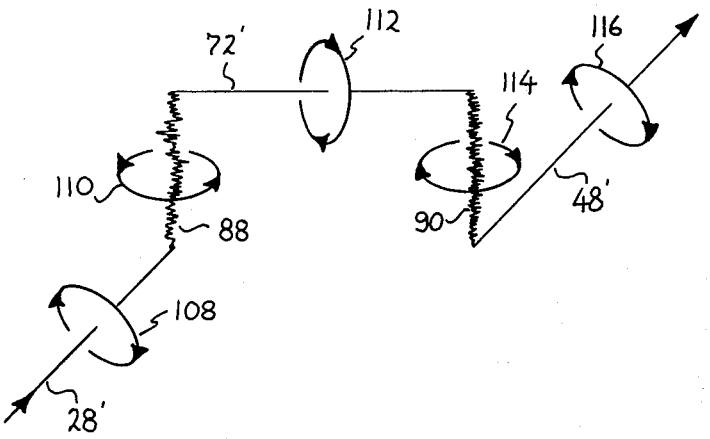
FIG. 9 is a schematic representation of current through the contactor and the magnetic flux fields generated thereby; and, FIG. 10 is a top view similar to FIG. 2 illustrating the resultant arc movement in the preferred form of the invention.

Referring now to FIG. 9 there is illustrated a simplified representation of the ideal current paths through the contactor 10. A current 28' in conductor 28 becomes the arc 88. This same current is indicated at 72' in contact bridge 72 and then as arc 90 before becoming current 48' in conductor 48. The magnetic field associated with current 28' is indicated at 108, that of arc 88 at 110, that of current 72' at 112, that of arc 90 at 114 and that of current 48' at 116. At the point at which current 28' changes direction by 90° to become the arc 88, there is a concentration of magnetic lines of flux which exert a force in a direction to attempt to maintain a straight line of current flow, i.e., to push the arc 88 in line with the current 28'. Similarly, the interactions between the flux lines generated by current 72' and the flux lines around the arcs 88 and 90 are such as to exert forces in directions to push the arcs in line with the current 72'. Interaction between the field 116 and the field 114 also trys to push arc 90 into line with current 48'. The arcs 88 and 90 also effect each other such that their respective flux fields exert forces attempting to push the arcs apart.

Figure 10:
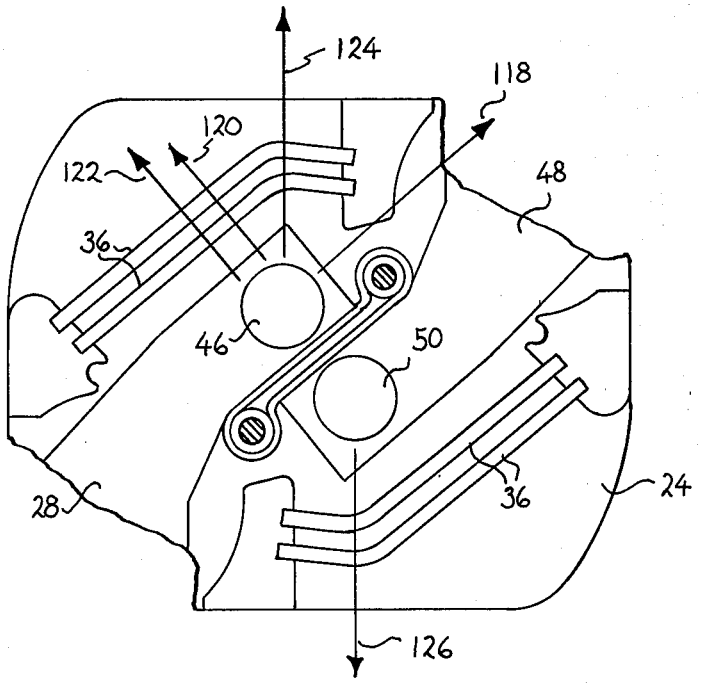

FIG. 10 is a top view of the contactor 10 with its cover removed and the contact bridge 72 and its housing 38 removed so that the forces exerted on the arcs 88 and 90 by the contactor structure described herein can be illustrated. The arrow 118 represents the direction of force on arc 88 caused by the reaction between the flux fields 108 and 110. The arrow 120 represents the force on arc 88 caused by the reaction between flux fields 110 and 112. The arrow 122 represents the force on arc 88 caused by the reaction between flux fields 110 and 114. The combination of these forces creates a resultant force to move the arc 88 in the direction indicated by the arrow 124. The forces exerted on arc 90 are mirror images of those exerted on arc 88 and create a resultant force to move arc 90 in the direction indicated by the arrow 126. The net result is to force the arcs 88 and 90 in directions 180 degrees apart. The direction of arc movement can be selected by positioning conductors 28 and 48 so that the relatively small screens 36 are positioned in the arc path and the arcs are not attracted to screws, rods and other metallic components in the contactor.

In one embodiment, the contactor 10 is rated to interrupt 100 amperes at 84 volts. In order to safely interrupt power at that level, the minimum contact opening has been established at approximately 0.2 inches. As is well known, the combined cathode and anode voltage drops for an arc are about 19 volts. Use of a dual break contactor such as shown herein results in two arcs with a combined total of 38 volts being dropped across the two anode cathode arc interfaces. Since the arc plasma comprises some volatized and partially ionized metals, depending on the composition of the contact tips, there exists a finite voltage drop over the arc length. For an arc plasma containing silver and cadmium oxides in a ratio of about 85:15, the voltage drop is approximately 140 volts per inch at the 100 ampere current level. Consequently, a 0.2 inch contact tip opening safely extinguishes a 100 ampere arc. This magnitude of contact tip separation is necessary since the measured magnetic flux field force on the arc at this current level is only sufficient to bow the arc outward about 0.030 inches off center. However, the force is proportional to the square of the current in the arc and at 1000 amperes has been observed to bow the arc about 3.0 inches off center.

In order to maximize the forces on any arcs it is necessary both to maintain the close spacing of the conductors in the contact area (in the order of ⅛ inch) and to construct the conductors of relatively thin but wide material. In this embodiment the conductors were constructed of material having a width of about 0.500 inch and a thickness of about 0.125 inch. These dimensions provided sufficient conductor cross sectional area to meet the current carrying design capability of the contactor without excessive heating or voltage drop. The ratio of about 4:1 for the width to thickness ratio of the conductor also assures that the magnetic field about the conductor is in a plane perpendicular to the field about any arcs between contact tips so that the fields interact to exert a force on the arcs.

In the illustrative embodiment of the present invention, a fault current arc, e.g., a 1000 ampere arc, will create a force which will rapidly "blow" an arc outward forcing its ends to move away from the contact tips and onto the conducting portions of the bridge 72 and conductors 28 or 48. The directions in which the arcs are blown is such as to force them into the screens 36 where they are split in two portions and rapidly cooled to aid in extinction. In actual testing, several hundred operations of the contactor were performed at current levels of 1000 amperes without any failure of the contactor and with minimal deterioration of the contact tips. The close spacing of the contact tips 46, 74 and 50, 76 necessitating the insulator 52, assures that the effect of the magnetic flux fields in forcing the arcs apart is maximized.

While the invention has been described in a preferred embodiment, other modifications and arrangements may become apparent to those skilled in the art. Accordingly, it is intended that the invention be limited only as necessitated by the scope of the appended claims.

What is claimed is:

1. Dual break electrical contactor structure comprising:

(a) an insulative base member;

(b) a first conductor attached to a surface of said base member, said first conductor having an end terminating on said surface, a finite portion of said first conductor approaching said end being substantially straight;

(c) a second conductor attached to said surface of said base member, said second conductor having an end terminating on said surface, a finite portion of said second conductor approaching said end thereof being substantially straight, said finite portion of said first conductor approaching said end thereof from a first direction and said finite portion of said second conductor approaching said end thereof from a second direction directly opposed to said first direction, each of said finite portions being spaced from but parallel to and overlapping the other of said finite portions in the plane of said surface;

(d) first and second contact tips mounted respectively on said first and second conductors adjacent their parallel overlapping finite portions;

(e) a conducting contact carrying bridge having a contact tip on each end thereof, each contact tip being positioned for mating with a corresponding one of said first and second contact tips on said first and second conductors, respectively; and, (f) means for causing said bridge to move between a non-contacting and a contacting position with said conductors whereby a current path may be formed between said first and second conductors when said bridge is in a contacting position and said current path is interrupted when said bridge is in said non-contacting position.

2. The electrical contactor structure of claim 1 and including:

(a) actuating means for causing said bridge to move between said non-contacting and said contacting positions;

(b) connecting means for connecting said bridge to said actuating means, said connecting means including pivoting means whereby said bridge pivots to assure disengagement between said bridge contact tips and each of said first and second contact tips of said conductors substantially simultaneously.

3. The contactor structure of claim 1 wherein each of said conductors comprises a substantially flat conducting member having a width several times its thickness.

4. The contactor structure of claim 3 in which the width of said conducting member is about four times its thickness.

5. An electromagnetically operated dual-break electrical contactor comprising:

(a) an electromagnetic coil assembly having a moveable armature mounted therein, said armature being spring biased into a first position when said coil assembly is deenergized and being magnetically biased into a second position when said coil assembly is energized;

(b) a housing for mounting and supporting said coil assembly;

(c) an insulative base member mounted on said housing, a distal surface of said base member being substantially flat;

(d) a first conductor attached to said distal surface of said base member, said first conductor extending from an edge of said base member to a termination point on said distal surface;

(e) a second conductor attached to said distal surface of said base member and extending from an edge of said member in a direction opposite to the extending direction of said first conductor, said second conductor having a termination point such that a portion of said second conductor is parallel to and overlaps a portion of said first conductor;

(f) first and second contact tips mounted on respective upper surfaces of said first and second conductors adjacent their parallel overlapping portions;

(g) a conducting contact carrying bridge having a contact tip on each end thereof, each contact tip being positioned for mating with a corresponding one of said first and second contact tips on said first and second conductors, respectively; and, (h) means for connecting said bridge to said armature whereby movement of said armature between said first and second positions causes said bridge to move between a non-contacting and a contacting position to thereby make and/or break contact between said contact tips on said bridge and said contact tips on said first and second conductors.

6. The contactor of claim 1 wherein said connecting means comprises a pivoting connection whereby said bridge pivots to assure disengagement between said bridge contact tips and each of said first and second contact tips of said conductors substantially simultaneously.

7. The contactor of claim 5 or 6 and including:

(a) a moveable insulative sheet interposed between said overlapping portions of said first and second conductors, said insulative sheet being biased toward said bridge whereby said sheet moves in concert with said bridge to thereby maintain an arc insulation barrier between said first and second conductors and between said tips on said bridge.

8. The contactor of claim 5 wherein each of said parallel overlapping portions of said conductors is substantially flat and has a width several times its thickness.

9. The contactor of claim 5 wherein each of said parallel overlapping portions of said conductors is substantially flat having a width about four times its thickness.

10. The contactor of claims 5 or 6 and including arc suppression means comprising a first wire mesh screen mounted thereon and positioned such that fault current arcs generated between said contact tips on disengagement are deflected into said screen.

11. The contactor of claim 10 wherein said arc suppression means includes a second wire mesh screen coextensive with said first screen and spaced a relatively short distance therefrom.

12. The contactor of claim 8 wherein said conductors extend beyond said contact tips mounted thereon.

13. The contactor of claim 6 wherein said pivoting connection means comprises:

(a) a cylindrical sleeve having a longitudinal slot;

(b) means attaching said sleeve to the midpoint of said bridge such that said slot is positioned at a location opposite from said attaching means;

(c) a cylinder fitting tightly within said sleeve; and (d) means connecting a center point of said cylinder to said armature, said slot being spread such that said cylinder can rotate within said sleeve to allow said bridge to pivot.

* * * * *